US005931233A

United States Patent [19]

La Bonte et al.

[11] Patent Number: 5,931,233

[45] Date of Patent: Aug. 3, 1999

[54] TWO-PHASE FIRE SUPPRESSION/ PROTECTION METHOD AND SYSTEM FOR STRUCTURES AND SURROUNDING GROUNDS

[75] Inventors: Paul La Bonte, Tustin Ranch; Wayne W. Spani, Mission Viejo, both of Calif.

[73] Assignee: Wildfire Protection Systems, Inc., Tustin Ranch, Calif.

[21] Appl. No.: 08/995,865

[22] Filed: Dec. 19, 1997

Related U.S. Application Data

[63] Continuation-in-part of application No. 08/714,546, Sep. 16, 1996, abandoned.

[51] Int. Cl.[6] ..... A62C 2/08

[52] U.S. Cl. ..... 169/5; 169/13; 169/14; 169/48; 169/61; 239/419.5

[58] Field of Search ..... 169/5, 13, 14, 169/15, 43, 44, 45, 46, 47, 48, 60, 61; 239/419.5

[56] References Cited

U.S. PATENT DOCUMENTS

| | | | |
|---|---|---|---|
| 2,571,877 | 10/1951 | Henshaw | 169/14 |
| 3,179,181 | 4/1965 | Banzato | 169/13 |
| 3,583,490 | 6/1971 | McFadden | 169/60 |
| 4,330,040 | 5/1982 | Ence et al. | 169/13 |
| 4,428,434 | 1/1984 | Gelaude | 169/13 |
| 4,630,684 | 12/1986 | Cinzori et al. | 169/46 |
| 4,991,657 | 2/1991 | LeLande, Jr. | 169/46 |
| 5,125,458 | 6/1992 | Berman | 169/16 |
| 5,165,482 | 11/1992 | Smagac et al. | 169/45 |
| 5,366,021 | 11/1994 | Coleman | 169/16 |

FOREIGN PATENT DOCUMENTS

| | | | |
|---|---|---|---|
| 652933 | 11/1991 | Australia | 169/13 |
| 2603194 | 3/1988 | France | 169/13 |
| 2672222 | 8/1992 | France | 169/13 |
| 4-266775 | 9/1992 | Japan | 169/13 |

*Primary Examiner*—Andrew C. Pike
*Attorney, Agent, or Firm*—John S. Christopher

[57] ABSTRACT

A two-phase fire suppression/protection method and system for structures and surrounding grounds includes a Phase1 and a Phase2. Phase1 is initiated first when a plurality of parabolic microphone sensors placed at the perimeter of the grounds surrounding the structure detect sound associated with an advancing wildfire. The parabolic microphone sensors provide a first signal to a system control unit which determines if a wildfire is advancing toward the structure. If a wildfire is identified, a filter and pumping system provides chemically treated water necessary to activate a plurality of parabolic volumetric distribution units located on the surrounding grounds. The distribution units generate a dome of high pressure cool air which encapsulates the structures and surrounding grounds for impeding the approach of the wildfire. Phase1 also employs a set of fog jet nozzles which atomize water under high pressure to produce a cool fog dispersion pattern which provides complete wide-area wetting and is sufficient to create, by air displacement, a high pressure envelope surrounding the structure. This pressure envelope eliminates the differential in pressure that often leads to an inrush of hot air and burning debris into the structure. Phase2 is initiated as the approaching flames are detected by additional sensors including smoke/particulate, thermal, and infrared sensors. Phase2 employs a set of spiral jet nozzles which are intended to create a dispersion that deluges the entire surface area of the structure with water. Water can be drawn from utility lines or from a secondary raw water source.

15 Claims, 6 Drawing Sheets

TWO-PHASE FIRE SUPPRESSION/ PROTECTION METHOD AND SYSTEM FOR STRUCTURES AND SURROUNDING GROUNDS

This is a continuation-in-part of application Ser. No. 08/714,546 filed Sep. 16, 1996, now abandoned.

BACKGROUND OF THE INVENTION

1. Field of the Invention

The present invention relates to the automated suppression of externally originated structural fires, particularly for structures exposed to wildfire, and more particularly to a fire suppression/protection method and system which employs a two-phase process to enhance efficacy in suppressing the ignition of the structure during its exposure to an external conflagration.

2. Description of the Prior Art

It is well known that certain geographical areas, particularly California, are prone to wildfires which can rage through inhabited areas destroying residential and commercial property worth millions of dollars. Wildfires are often ignited by natural phenomena such as by lightening storms or caused by mankind. Once a wildfire is ignited, it creates an environment that requires fuel, oxygen, and suitable temperature conditions to continue to exist. It has been recognized that a structure having a system which could automatically operate to wet the structure during exposure to such a conflagration would have a considerably higher probability of surviving the fire than if the structure were not wetted during its exposure to burning cinders and flames.

Thus, numerous systems have been proposed to provide fire suppression by wetting the structure during its exposure to a wildfire. These prior art fire suppression system have attempted to solve operational problems created by the extremely harsh environment in which they must operate. For example, the availability of water from the public supply main line could be terminated or severely reduced during such a fire. Most of the disclosed systems have been directed to using water sources other than the main water supply provided by the local city or municipality to the structure. These alternate water sources are typically swimming pools, but could also be lakes, wells, tanks, or the like.

Often, the owners or occupants of a structure in a wildfire zone have voluntarily evacuated or been required by authorities to evacuate before the wildfire has reached the threshold of the structure. Further, other fire suppression systems known in the prior art have disclosed remote operation using local sensors and telephone lines to transmit signals. The use of alternate sources of power, such as batteries, has also been disclosed in situations in which the main source of electrical power to the structure has been interrupted.

Typically, combustion of structures during a wildfire can be initiated by the radiant heat generated by the conflagration. This occurs because the radiant heat raises the temperature of the structure to the point that the structure ignites. Of course, external combustion of the structure can also be initiated by direct contact with the fire. Often, the ignition of the structural fire occurs internally. Generally, this occurs when the internal air temperature of the structure exceeds the external ambient temperature. As the temperature inside the structure increases, the internal air becomes less dense and rises. This situation creates a partial vacuum inside the structure causing heated ambient air carrying fire embers outside of the structure to travel inside through the eves of the structure. Thus, the fire typically ignites in the attic of the structure.

Virtually none of the external fire suppression systems heretofore disclosed in the prior art has achieved commercial success. The reasons for the lack of commercial success are as follows. First, it is not a simple matter to design an external fire suppression system that provides wetting coverage of a residence or other structure that is effective in suppressing ignition of the structure while being assailed by the firestorm associated with a wildfire. The heat of such fires and the associated thermal vortex will combine with preexisting hot, dry winds to knock down or severely degrade the throw patterns of sprinkler heads as disclosed in numerous prior art systems. The maintenance of these throw patterns during such conditions is critical to achieving a complete and effective wetting of the surface area of the structure. Moreover, the high winds and temperatures will rapidly evaporate the water from the surface of the structure, thus further adding to the extreme difficulty in maintaining a complete and continuous (i.e., effective) wetting of the entire surface area of the structure.

Second, the extremely high temperatures can, often cause the internal temperature of the structure to rise to a level such that items within the structure will spontaneously combust, even though the outside of the structure has not been ignited. Third, and perhaps most importantly, the thermal effects of a wildfire will create a high pressure envelope around the outside of the structure relative to that inside the structure, which often leads to a rush of hot dry air into the structure bearing flames and hot embers which can ignite the flammable contents of the structure.

None of the prior art fire suppression system designs heretofore disclosed has addressed the above-noted phenomenon. Thus, there is still a need for a fire suppression and protection system which can solve the foregoing problems presented by the severe conditions under which the system must operate.

SUMMARY OF THE INVENTION

Briefly, and in general terms, the present invention provides a new and improved fire suppression/protection method and system which operates in two phases to more effectively prevent or minimize the damage to or loss of property from fire and associated heat.

Phase1 of system operation is initiated first when a plurality of parabolic microphone sensors placed at the perimeter of the grounds surrounding the structure detect sound associated with an advancing wildfire which typically precede the arrival of the fire by up to two thousand feet. The parabolic microphone sensors provide a first signal to a system control unit which determines if a wildfire is advancing toward the structure. If a wildfire is identified, a filter and pumping system provides chemically treated water necessary to activate a plurality of parabolic volumetric distribution units located on the surrounding grounds. The distribution units generate a dome of high pressure cool air which encapsulates the structures and surrounding grounds for impeding the approach of the wildfire.

Phase1 of system operation also employs a set of fog jet nozzles which atomize water under high pressure to produce a cool fog dispersion pattern within the larger dome of high pressure cool air. The number of fog jet nozzles required for a given structure is dictated by the surface area of the structure, the typical area covered by the throw pattern of each nozzle, and the overlap of the coverage area between each set of nozzles to adequately compensate for the effects of the severe winds and is calculated to ensure complete wetting of the entire surface area of the structure and the surrounding grounds prior to the arrival of flames capable of igniting the structure.

Phase2 of system operation is initiated as the approaching flames are detected by additional sensors including smoke detectors that sense an increase in particulate matter in the air, heat detectors that sense the advancing thermal wave, as well as infrared sensors. Phase2 of system operation employs a set of spiral jet nozzles to produce an extended throw pattern of a higher volume of water than that of Phase1. The number of spiral jet nozzles required to be employed for a given structure is also dictated by surface area coverage requirements, the typical throw area covered by each nozzle, and an overlap of coverage area between each set of nozzles to adequately compensate for the effects of the severe winds. The number of spiral jet nozzles calculated for a specific structure is intended to create a dispersion that deluges the entire surface area of the structure with water as the wildfire flames pass through the area surrounding the structure.

The Phase1 fog jet nozzles are selected to create a fog dispersion pattern of a particular density of water particles of specific size variations at a specified velocity. This dispersion pattern creates an internal dome of moist cool air which ensures that the entire surface area of the structure and a surrounding area are enveloped and saturated, even in the face of the high winds typically associated with a wildfire. Moreover, this dispersion of water particles is sufficient to create, by air displacement, a pressure envelope surrounding the structure. This pressure envelope eliminates the differential in pressure that often leads to an inrush of hot air and burning debris into the structure through openings such as eave vents, thereby preventing structure ignition from within. Additionally, this pressure envelope lowers the temperature of the structure, its interior, and the air surrounding the structure which further suppresses external and internal ignition of the structure.

Phase1 of system operation is initiated by the system control unit which receives the first signal from the plurality of parabolic microphone sensors which detects the sounds produced by the advancing wildfire. Phase2 of system operation is also initiated by the system control unit by integrating a plurality of electronic signals from a plurality of sensors that measure the level of heat, the amount of particulate in the air (i.e., smoke), and the presence of flames by the use of infrared detectors. The system control unit can also be operated manually, if necessary.

In a preferred embodiment of the invention, a biodegradable surfactant or water-wetting compound and fire retardant are combined and blended with source water in a chemical mixing tank which is coupled to the water source. The wetting compound retards evaporation despite the severe environment, increases surface tension thereby causing the water to adhere to surfaces the water comes in contact with, and increases the density of the water. The protein-based fire retardant is readily absorbed into the fibrous surfaces of the structure, significantly retarding combustibility and flammability, while also increasing the density of the water and reducing the evaporation rate.

The present invention is typically coupled to the structural water supply, which is fed to the chemical balancing and mixing tank. The present invention also comprises a raw water inlet which is designed to draw raw water from alternate supplies such as pools, spas, water tanks (above and below ground), lakes, wells, etc. The raw water inlet comprises two screened suction inlets, each coupled to one of a pair of suction pumps. Typically, one of the suction inlets and its corresponding suction pump is used one at a time while the other suction inlet is backwashed using a sidestream from the suction pump currently in use. If the suction inlet currently in use becomes clogged, the system switches to the alternate suction inlet and corresponding pump while the clogged suction inlet is backwashed and freed of debris. It is noted that both suction inlets and their corresponding suction pumps and both of the high pressure discharge pumps can be operated simultaneously.

The water discharged from each of the influent suction pumps is then coupled to a self-cleaning filter that removes small pass-through particles which could clog and foul the fog jet nozzles. The output from the self-cleaning filter is then coupled to the chemical balancing and mixing tank. A fluid level regulator controls the influent suction pumps as well as the high pressure pumps which pump the fluid from the mixing tank to the nozzles of both Phase1 and Phase2 of system operation.

The present invention preferably comprises a duplex high-pressure pump system for delivering the fluid from the chemical balancing and mixing tank to the nozzles with the requisite pressure for the two separate phases of operation. The duplex system provides redundancy in the event that one of the high pressure pumps fails.

Each of the duplex high pressure pumps is coupled to a Phase1 and a Phase2 distribution header. Thus, the Phase1 distribution header is coupled to the set of fog jet nozzles and the Phase2 distribution header is coupled to the set of spiral jet nozzles. The two sets of nozzles are preferably deployed in the eaves and roofing surfaces of the structure such that the spray patterns of the adjacent nozzles overlap sufficiently to ensure complete coverage of all surfaces while preserving the water supply. In case one of the headers fails to provide sufficient pressure, both Phase1 and Phase2 can be operated from the same distribution header. If both distribution headers fail to provide sufficient pressure, a combination of the two headers can be used.

The fire suppression/protection system can be powered using the utility electrical supply to the structure, or by a self-activated and self-contained power generator in the event that the electrical supply to the structure is interrupted or becomes otherwise unavailable. The system can operate manually or automatically, and its operation is coordinated by a process logic program of the system control unit.

These and other objects and advantages of the present invention will become apparent from the following more detailed description, taken in conjunction with the accompanying drawings which illustrate the invention, by way of example.

DESCRIPTION OF THE INVENTION

Figure 1:
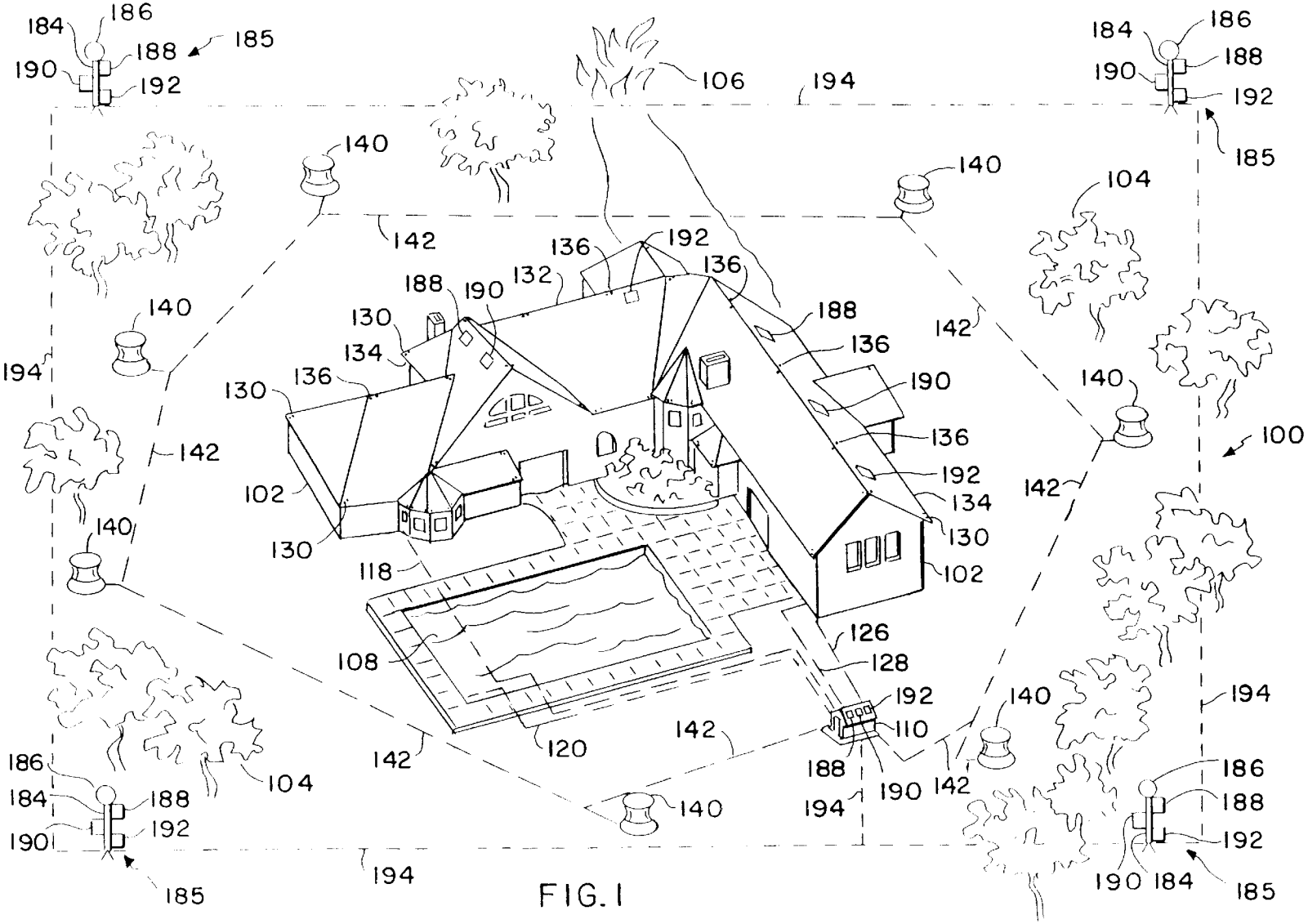
FIG. 1 is an aerial perspective view of a two-phase fire suppression/protection system for structures and surrounding grounds and method therefor showing a plurality of protected structures, a plurality of atomizing fog jet nozzles and spiral jet nozzles, a water source, and a plurality of parabolic volumetric distribution units located on the surrounding landscape.

The present invention is a two-phase fire suppression/protection method and system 100 for structures and surrounding grounds as shown in FIG. 1. The fire suppression/protection method and system 100 of the present invention is integrated into a structure 102 and surrounding grounds 104 for suppressing an approaching wildfire 106 and for protecting the structure 102 and surrounding grounds 104 from fire damage. The fire suppression/protection method and system 100 is typically employed by the owner of a residence but can also be utilized by the owners of commercial and industrial buildings.

Figure 5:
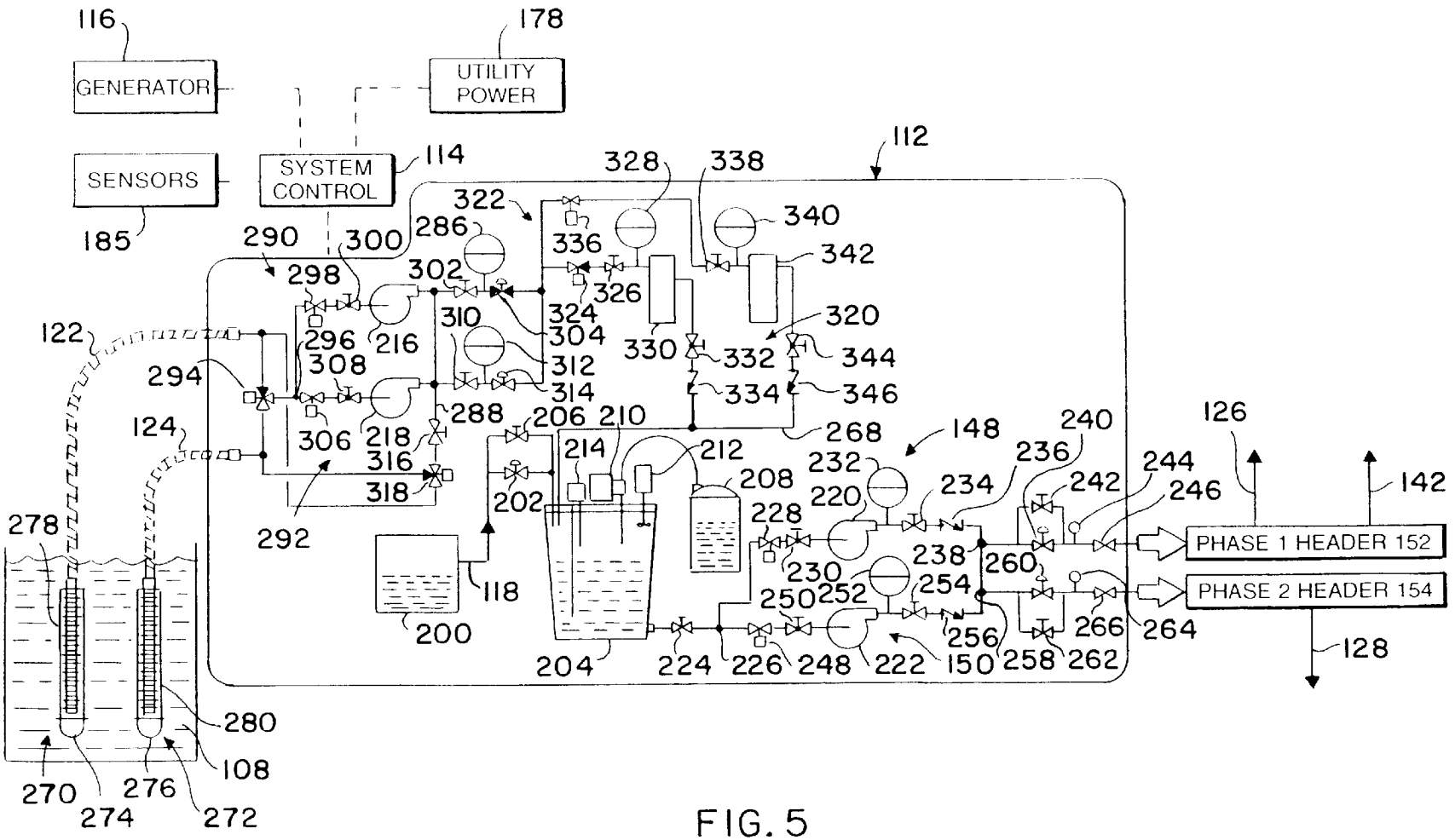
FIG. 5 illustrates schematically the fire suppression/protection system of the present invention.

A preferred embodiment of the general layout of the fire suppression/protection system 100 is shown in perspective in FIG. 1 and includes the structure 102 having a swimming pool which serves as an alternate raw water supply 108. Located adjacent to the structure 102 is a pump house 110. The pump house 110 houses a duplex pumping station 112, a system control unit 114, and a backup electrical power generator unit 116, each shown in FIG. 5. A structure utility water line 118 is shown circuited underground from the structure 102 to the pump house 110 in FIG. 1. The utility water line 118 provides the normal water supply to the duplex pumping station 112 of the fire suppression/protection system 100 as is shown in FIG. 5. A raw water intake line 120 is also shown circuited underground in FIG. 1 from the raw water supply 108 (i.e., the swimming pool) to the pump house 110. The raw water intake line 120 provides an alternate supply of water to the duplex pumping station 112 of the fire suppression/protection system 100 in case the water supply in utility water line 118 fails. The raw water line 120 is shown in FIG. 1 as a single line but actually includes a pair of two-inch flexible lines 122 and 124 clearly shown extending between the duplex pumping station 112 and the raw water supply 108 in FIG. 5.

A fog jet water line 126 and a spiral jet water line 128 are each shown circuited underground from the structure 102 to the pump house 110. The fog jet water line 126 provides a source of chemically treated water from the duplex pumping station 112 shown in FIG. 5 to a plurality of fog jet nozzles 130 positioned along the roof line 132 and about the structure eaves 134 where hot air and burning debris often enter structure eave vents during a wildfire event. The fog jet nozzles 130, associated with Phase1 of the system operation, serve to atomize water under high pressure to produce a cool fog dispersion pattern best shown in FIG. 2.

The number of fog jet nozzles 130 required for a given structure 102 is dictated by the type of surface and the surface area of the structure 102, the typical area covered by the throw pattern of each fog jet nozzle 130, and the overlap of the coverage area between each set of fog jet nozzles 130 to adequately compensate for the effects of the severe winds and surface effect. Further, the number of fog jet nozzles 130 utilized is calculated to ensure complete wetting of the entire surface area of the structure 102 and the surrounding grounds 104 prior to the arrival of flames capable of igniting the structure 102. Further, the Phase1 fog jet nozzles 130 are selected to create a fog dispersion pattern of a particular density of water particles of specific size variations at a specified velocity. This dispersion pattern ensures that the entire surface area of the structure 102 and the surrounding grounds 104 are enveloped and saturated, even in the face of the high winds typically associated with a wildfire event.

The fog jet nozzles 130 employed for Phase1 in the preferred embodiment of the present invention are Spray Systems FogJet Model 1-7N-SS-18 which are available from the Hengst Company, Inc. of Laguna Hills, Calif. The fog jet nozzles 130 are designed to provide a maximum flow rate of three gallons per minute at 80 psig, and a full cone spray pattern angle of 120°, an outer spray diameter of nine feet, and an inner spray diameter of six feet. Other fog jet nozzles known in the art which provide similar operating characteristics can also be used.

The spiral jet water line 128 provides a source of chemically treated water from the duplex pumping station 112 shown in FIG. 5 to a plurality of spiral jet nozzles 136 also positioned along the roof line 132 where burning debris and embers carried by the wind often cause ignition of the structure 102. The spiral jet nozzles 136, associated with Phase2 of the system operation, serve to deluge the structure 102 by providing an extended throw pattern of a higher volume of water than that provided in the Phase1 operation best shown in FIG. 3.

The number of spiral jet nozzles 136 required to be employed for a given structure 102 is also dictated by surface area coverage requirements of the structure 102, the typical throw area covered by each spiral jet nozzle 136, and an overlap of coverage area between each set of spiral jet nozzles 136 to adequately compensate for the effects of the severe winds. The number of spiral jet nozzles 136 calculated for a specific structure 102 is intended to create a dispersion pattern that deluges the entire surface area of the structure 102 with water as the flames of the approaching wildfire 106 pass through the area surrounding the structure 102.

Figure 2:
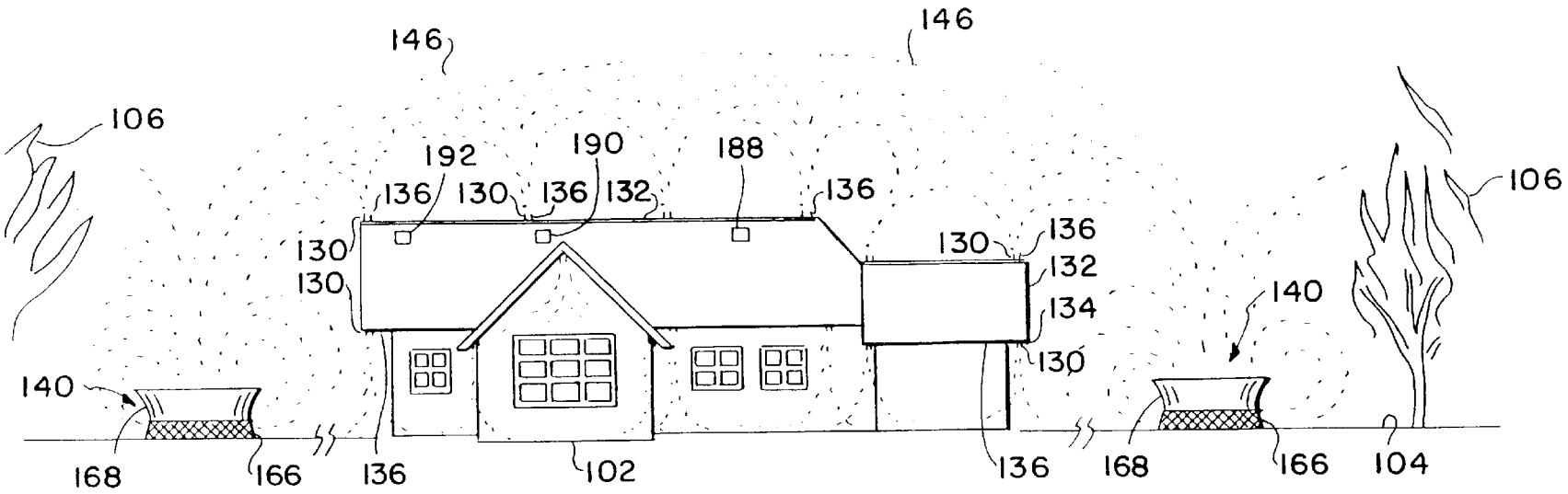
FIG. 2 is a rear elevation view of the fire suppression/protection system of FIG. 1 illustrating Phase1 of the system which provides an external high pressure dome of water vapor enclosing the protected structures and surrounding grounds and an internal high pressure evaporative cloud of water vapor covering an individual protected structure within the external high pressure dome of water vapor.
Figure 3:
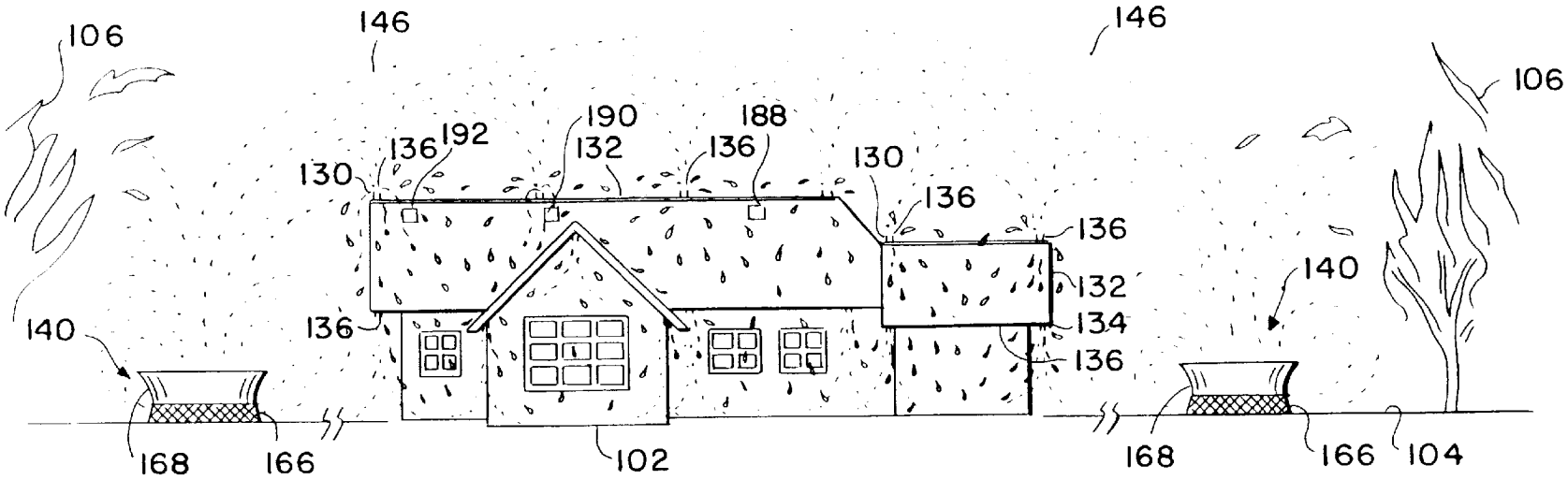
FIG. 3 is a rear elevation view of the fire suppression/protection system of FIG. 1 illustrating the activation of Phase2 of the system comprising a plurality of spiral nozzles for deluging an individual protected structure in combination with the external dome and internal evaporative cloud of water vapor of Phase1.

The spiral jet nozzles 136 employed for Phase2 of the operation in the preferred embodiment are Spray Systems SpiralJet model 3/8-HHSJ-170-40 which are also available from the Hengst Company, Inc. of Laguna Hills, Calif. The spiral jet nozzles 136 are designed to produce a flow rate of 8 gallons per minute at a pressure of 40 psig, and a spray diameter of thirty feet at an angle of 170°. Both the fog jet nozzles 130 and the spray jet nozzles 136 are preferably deployed along the eaves and on the roof surfaces of the structure 102 as shown in FIGS. 1–3. Other spiral jet nozzles known in the art which provide similar operating characteristics can also be employed.

Positioned about the surrounding grounds 104 is a plurality of parabolic volumetric distribution units 140 which are each connected via an underground water line 142. The underground water line 142 is directly connected to the pump house 110 as shown in FIG. 1. The underground water line 142 serves to carry chemically treated water from the duplex pumping station 112 located in the pump house 110 to the plurality of parabolic volumetric distribution units 140 during Phase1 of the system operation. The function of the plurality of parabolic volumetric distribution units 140 is to create a dome of high pressure cool air 146 for encapsulating and protecting the structure 102, pump house 110, and surrounding grounds 104 from the approaching wildfire 106 as is clearly illustrated in FIGS. 2 and 3. The dome of high pressure cool air 146 is an artificially created atmospheric condition that serves to prevent the approaching wildfire 106 from entering the surrounding grounds 104 which also serves to protect the structure 102.

The approaching wildfire 106 is prevented from entering the surrounding grounds 104 for the following reason. The air associated with a wildfire 106 is very hot and contains little moisture and thus exhibits a low pressure which, in turn, causes the hot air to rise. The air surrounding the wildfire 106 is being heated by the fire. The air is cooled and contains somewhat more moisture and thus exhibits a pressure somewhat higher than the air associated with the wildfire 106. However, the dome of high pressure cool air 146 generated by the parabolic volumetric distribution units 140 exhibits a pressure higher than the pressure exhibited by the air associated with and surrounding the wildfire 106. This situation exists because the air located above the structure 102 and surrounding grounds 104 has been cooled through an evaporative process utilizing the parabolic volumetric distribution units 140 and the chemically treated water provided by the duplex pumping station 112.

It is well known that cool air is heavier than warm air. If the ambient air located above the structure 102 and the surrounding grounds 104 is cooled, the warm and hot air associated with the approaching wildfire 106 can be forced away. The air is cooled by means of the evaporation of the chemically treated water provided by the duplex pumping station 112 to the parabolic volumetric distribution units 140. The chemically treated water is the primary evaporation agent. The parabolic volumetric distribution units 140 are designed and sized to atomize and distribute the chemically treated water into the ambient atmosphere to cause effective evaporation. During the evaporation process, heat is transferred from the ambient air to the chemically treated atomized water. The chemically treated atomized water functions as a heat sink thereby cooling the air. The air density of the cooled air increases because the air molecules have become more tightly packed. The higher air density results in higher air pressure within an evaporative zone. The dome of high pressure cool air 146 becomes heavier and thus sinks and mounds over the structure 102, pump house 110, and the surrounding grounds 104. The construction and operation of the parabolic volumetric distribution units 140 will be described hereinbelow.

The air located above the structure 102 and surrounding grounds 104, having been cooled through the evaporative process, includes greater air density resulting in a higher air pressure. This relationship between the temperature, density, and pressure of the air is set forth in the mathemathical expressions known as the Equations of State. The Equations of State make clear that since air and vapor density, collectively, is a function of both temperature and pressure, then the air and vapor density is correlated by the Equations of State. The Equations of State are discussed in detail in Perry's Chemical Engineering Handbook, McGraw-Hill Publishing Company, sixth edition (various pages), copyright 1984. Because the dome of high pressure cool air 146 is at a pressure higher than the pressure of the air associated with and surrounding the wildfire 106, the wildfire is unable to advance onto the grounds 104 surrounding the structure 102. This is because when a heavy mass of high pressure air is encountered, the wildfire will bypass it seeking the path of least resistance. The design of the two-phase fire suppression/prevention method and system 100 is intended to prevent the wildfire from entering the surrounding grounds 104, not to extinguish the fire that is already consuming the structure 102.

In the alternative, the wildfire 106 will advance upon an area of lower resistance, i.e., an area not covered by the dome of high pressure cool air 146 and thus having air of a lower pressure. The generation of the dome of high pressure cool air 146 provides the additional benefit of thoroughly wetting the structure 102, pump house 110, and the surrounding grounds 104. The wetting serves to prevent ignition of the structure 102 should burning debris or hot embers be carried onto the surrounding grounds 104, structure 102, or pump house 110 by the high wind normally associated with a wildfire event. Thus, the plurality of parabolic volumetric distribution units 140 that generate the dome of high pressure cool air 146 which encapsulates the structure 102 cooperate with the plurality of fog jet nozzles 130 that produce a cool fog dispersion pattern about the roof line 132 and eaves 134 of the structure 102. This cooperation between these two separate water atomizing portions of the fire suppression/protection system 100 provides maximum protection to the structure 102 and the surrounding grounds 104 during Phase1 of system operation.

The dome of high pressure cool air 146 is self-aligning to the approaching wildfire 106. The hot low pressure air associated with the approaching wildfire 106 begins to draw the ambient air toward it. This effect is caused when the hot low pressure air associated with the wildfire 106 rises and the higher pressure ambient air moves in along the ground surface to replace the rising air. This effect can occur when the wildfire is four hundred to five hundred yards away. As the low pressure air of the wildfire 106 approaches the surrounding grounds 104, the dome of high pressure cool air 146 is also pulled toward the front of the wildfire 106, i.e., the zone of the lowest pressure air. The heavy high pressure cool air is drawn toward the wildfire front serving to impede the pathway of the advancing firestorm. Thus, the advance of the wildfire 106 is impeded and changes direction to avoid the surrounding grounds 104 (and to seek the path of least resistance) which is covered by the dome of high pressure cool air 146. When the wildfire 106 changes direction, the dome of high pressure cool air 146 also experiences a corresponding change in direction because the cool high pressure air 146 is drawn into the hot low pressure rising air associated with the wildfire 106. The movement of the dome of high pressure cool air 146 is controlled by the hot low pressure air associated with the approaching wildfire 106. This phenomena assures that the greatest area of suppression and protection will always be directed toward the approaching wildfire 106.

As the wildfire 106 draws the dome of high pressure cool air 146 toward the fire front, the area of protection extends beyond the boundaries of the surrounding grounds 104. The interface at where the dome of high pressure cool air 146 terminates and the hot low pressure air associated with the wildfire 106 begins is the point at which equalization has been reached. The point of equalization can extend beyond the boundaries of the surrounding grounds 104. At the interface between the two air masses, the dome of high pressure cool air 146 is absorbing heat from the approaching wildfire 106 and the hot low pressure air associated with the wildfire 106 is dissipating heat to the high pressure cool air 146. This heat exchange or transfer eventually results in temperature stabilization which identifies the point of equalization. Under these conditions, the wildfire 106 can no longer advance toward the protected surrounding grounds 104 and changes direction to an area of less resistance and lower air pressure. Since the direction of the wildfire 106 is constantly changing, the interface or point of equalization where the dome of high pressure cool air 146 meets the hot low pressure air associated with the wildfire 106 also changes. If fuel is not available in the new direction, the wildfire 106 will burn itself out.

The plurality of parabolic volumetric distribution units 140 receive chemically treated water from the duplex pumping station 112. In FIG. 1, each of the parabolic volumetric distribution units 140 is shown receiving the treated water via the underground water line 142. The duplex pumping station 112 is designed to have an alternating water feed capability via a first high pressure pumping section 148 or a second high pressure pumping section 150 as shown in FIG. 5. Located at the discharge end of the first high pressure pumping section 148 is a Phase1 header 152. Likewise, located at the discharge end of the second high pressure pumping section 150 is a Phase2 header 154. Either or both of the high pressure pumping sections 148 or/and 150 can charge the Phase1 header 152 or the Phase2 header 154, or in the alternative charge both the Phase1 header 152 and the Phase2 header 154 simultaneously.

The underground water line 142 leading from the pump house 110 to the parabolic volumetric distribution units 140 is connected to the Phase1 header 152 as shown in FIG. 5. Therefore, the water line 142 carries chemically treated water from either the first high pressure pumping section 148 or the second high pressure pumping sections 150 or from both of the high pressure pumping sections 148 and 150 simultaneously. This capability is realized because of a crossover valving design utilized in the duplex pumping station 112 which will be described during the discussion of FIG. 5 hereinbelow.

Figure 4:
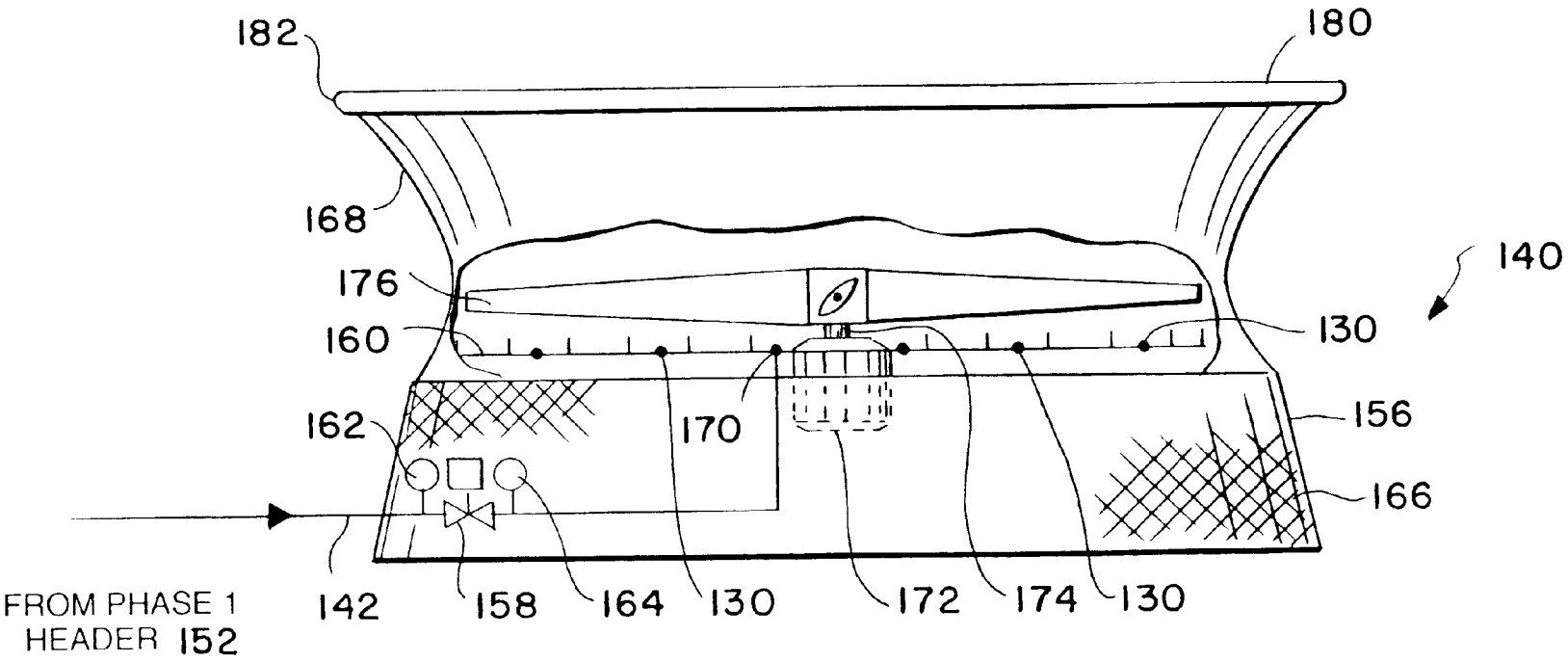
FIG. 4 is an elevation, partly cutaway, of a parabolic volumetric distribution unit of the fire suppression/protection system of FIG. 1 showing the water intake and feed arrangement, drive motor, and multi-blade fan for generating the external high pressure dome of water vapor in Phase1 of the system.

The underground water line 142 enters the base 156 of the parabolic volumetric distribution unit 140 as is shown in FIG. 4. An automatically operated solenoid control valve 158 is positioned within the water line 142. When the valve 158 is in the open position, the chemically treated water can flow through the water line 142 to a distribution header 160. However, when the valve 158 is in the closed position, the water line 142 is blocked so that the parabolic volumetric distribution unit 140 can be taken out of service for maintenance and repair. Positioned in the water line 142 on both sides of the valve 158 are pressure gauges 162 and 164, respectively. The gauges 162 and 164 serve to enable measurement of the line water pressure both downstream and upstream of the valve 158.

The base 156 is surrounded by an air inlet debris and safety screen 166 which is employed to prevent debris and other matter, including small animals, from entering the base 156 of the parabolic volumetric distribution unit 140. Mounted upon the base 156 is a parabolic vapor distribution ring 168 which is employed to direct the projected atomized water vapor into the ambient air above the structure 102 and surrounding grounds 104.

The water line 142 forms a T-junction 170 with the distribution header 160. The T-junction enables the chemically treated water to be passed from the water line 142 to the distribution header 160. The distribution header 160 is circular in shape and is mounted above the base 156 and in the bottom of the parabolic vapor distribution ring 168 by mechanical methods known in the art. The distribution header 160 includes a plurality of the fog jet nozzles 130 mounted therein. The fog jet nozzles 130 utilized in the distribution header 160 are the same fog jet nozzles 130 employed along the roof line 132 and eaves 134 of the structure 102 during Phase1 of the system operation. During operation, the water line 142 is charged by operation of either the first or second high pressure pumping sections 148 and 150. The charging pressure forces the treated water into the distribution header 160 and out of the plurality of fog jet nozzles 130 to provide an atomized water vapor in the form of a mist.

A weatherproof electric motor 172 (partially shown in phantom) is mounted in conjunction with the distribution header 160 by mechanical methods known in the art as is shown in FIG. 4. The motor 172 includes a driven armature shaft 174 having a fan blade 176 mechanically attached thereto. The function of the motor 172 and the fan blade 176 is to draw upward and project into the ambient air the atomized water vapor provided by the plurality of fog jet nozzles 130 positioned on the distribution header 160. The plurality of parabolic volumetric distribution units 140 work in combination to project a sufficient volume of atomized water vapor into the ambient air to produce the dome of high pressure cool air 146 utilized to impede the approaching wildfire 106 from entering the surrounding grounds 104. The required horsepower rating of the electric motor 172 is determined by the particular application. For example, the height of trees, proximity to buildings, overall terrain, and the characteristics of the fog jet nozzles 130 mounted therein should be considered when selecting the horsepower rating of the motor 172.

The electric motor 172 of each of the parabolic volumetric distribution units 140 is normally energized by utility electric power 178 provided to the structure 102 by a local utility. The utility electric power 178 is provided to the system control unit 114 located in the pump house 110 as is shown in FIG. 5. In the event that the utility electric power 178 fails, the backup electrical power generator unit 116 located in the pump house 110 and shown in FIG. 5 will be automatically energized. When not in use, the parabolic vapor distribution ring 168 of each of the parabolic volumetric distribution units 140 is covered by a debris/weather cover 180 as is shown in FIG. 4. The debris/weather cover 180 can be comprised of any lightweight weatherproof material having an elastic edge which is secured to a top curled lip 182 of the parabolic vapor distribution ring 168. When the parabolic volumetric distribution unit 140 is energized, the upward force of the air produced by the fan blade 176 forcibly removes the debris/weather cover 180.

The number of parabolic volumetric distribution units 140 required to provide a zone of high pressure cool air necessary is determined by the size of the surrounding grounds 104 and the arrangement of the structure 102 to be protected. In particular, the size and terrain of the surrounding grounds 104, the architecture of the structure 102, and the proximity of the parabolic volumetric distribution units 140 to the structure 102 (or structures) including the pump house 110 should be considered. Also, the horsepower rating of the electric motor 172 in each of the parabolic volumetric distribution units 140 and the characteristics of the fog jet nozzles 130 used should be considered. More than a single evaporative zone may be required. Further, the amount of water required from the utility supply and/or the raw water supply 108 depends upon the size of the fire suppression/protection system 100, the amount of fire fuel present, the size of the surrounding grounds 104, and the arrangement of the structure 102 or structures.

Electronic signals from sound, heat, infrared, and smoke sensors are transmitted to and integrated by a process logic controller at the system control unit 114. These sensors are placed strategically around the structure 102 and grounds 104 in a manner which overlaps the "view-shed" of the sensors to provide complete coverage of the structure 102 and surrounding grounds 104. The sound sensors are used to detect the approaching fire 106 in sufficient time to trigger Phase1, which uses atomizing fog jet nozzles 130 to produce a pressurization envelope and a cooling fog around the structures 102 and grounds 104. The fog-like condition produces a thorough wetting of the structure surfaces with water mixed with a wetting agent and a fire retardant. The wetting agent is preferably a nonvolatile, biodegradable, polymer-based surfactant. The wetting agent serves to retard evaporation of the water. The atomized water also serves to equalize the pressure between the inside and outside of the structure to avoid the commonly observed problem of air rushing into the structure through eaves or other openings.

The heat, smoke, and infrared detectors are used to trigger Phase2 upon their detection of the imminent arrival of the flames and/or burning debris and/or detecting temperatures at or near combustion. Phase2 provides water through a series of high-volume spiral jet nozzles 136 to produce a deluge across the entire surface area of the structure 102, soaking the surface of the structure 102 continuously as the flames pass through the area surrounding the structure 102 being protected.

There are four types of sensors receiving external stimuli and in turn transmitting electronic signals to the process logic controller of the system control unit 114; these are: sound detection sensing hot and cold air molecules colliding during a wildfire event; infrared detection sensing intensity levels of heat; photoelectric detection sensing intensity levels of flame; and smoke detection sensing intensity levels of particulate matter in the air. These sensing units are strategically stationed throughout the structure(s) 102 and/or property in such a manner that the sensing viewed-shed for the most likely avenues of approaching fire are thoroughly covered and overlapped to provide redundancy. The sensing units are active at all times during the day, except when being maintained or tested. When an external stimulus is received by the sensing unit, the unit transmits an electronic signal to the process logic controller within the system control unit 114 where its signal and those from the other sensing units are integrated and crosschecked for validation prior to triggering the automatic start-up of the protective system. The sound detection sensing unit is readily available from Spy Equipment in Long Beach, Calif. The smoke detection and photoelectric flame detection sensing units are readily available from Grainger Industrial and Commercial Equipment and Supplies located in Santa Ana, Calif. and manufactured by Edwards and Dicon, respectively. The heat detection sensing unit is readily available from Cole-Parmer Instrument Company located in Niles, Ill.

The plurality of four sensing units (identified collectively as sensors 185) discussed immediately above are distributed, for example, at each of four corners of the surrounding grounds 104 as shown in FIG. 1. The plurality of sensors 185 can be, for example, distributed in groups of four (i.e., one of each type of sensors 185) which are mounted upon a vertical stanchion 184. Each of the vertical stanchions 184 can be located on the perimeter of the surrounding grounds 104. The four sensors 185 include a parabolic microphone sensor 186 for detecting the sounds of hot and cold air molecules colliding during a wildfire 106, a heat sensor 188 for detecting the temperature of the approaching thermal wave associated with the wildfire 106, a smoke detector 190 for sensing the increase of particulate in the air, and an infrared detector 192 for detecting the intensity levels of the heat associated with the wildfire 106. Each of the above mentioned sensors 185 for sound, temperature, particulate, and intensity levels are electrically circuited through the corresponding vertical stanchion 184 and into an underground conduit 194 as shown in FIG. 1. The underground conduit 194 is connected directly to the system control unit 114 located within the pump house 110 as shown in FIGS. 1 and 5.

In addition to the sensors 185 mounted upon the vertical stanchions 184 located at the perimeter of and on the surrounding grounds 104, a plurality of heat sensors 188, smoke detectors 190, and infrared detectors 192 are mounted on the roofs of the structure 102 and the pump house 110 as shown in FIGS. 1–3. Each of the sensors 185 mounted upon the roofs of the structure 102 and pump house 110 are also circuited to the system control unit 114 shown on FIG. 5. In this manner, each of the sensors 185 is directly connected to and transmits electronic signals to the system control unit 114. In turn, the system control unit 114 can integrate and crosscheck each of the electronic signals for validation prior to triggering the automatic start-up of the fire suppression/protection system 100.

It is believed that of all the sensors 185 employed to collect external stimuli for identifying an approaching wildfire 106, the use of the sound sensor, i.e., the parabolic microphone sensor 186, is novel. The parabolic microphone sensor 186 is known in the art and exhibits the construction of a parabolic dish that is capable of receiving a plurality of wildfire generated signals. The wildfire generated signals have a range of frequencies produced by the collision of the molecules of hot air associated with the wildfire and the molecules of cooler ambient air surrounding the wildfire. Like the remainder of the sensors 185, the parabolic microphone sensor 186 transmits the received wildfire generated signals to the system control unit 114. It is the sound frequencies of the wildfire generated signals that are processed by the logic controller within the system control unit 114 that identifies an approaching wildfire 106 and initiates Phase1 of the system operation. An example of a parabolic microphone sensor 186 known in the art is manufactured by either the Dan Gibson Company or the Audio Telescope Company and available from Spy Equipment in Long Beach, Calif.

The method and apparatus of the duplex pumping station 112 of the present invention is described in detail with reference to FIG. 5. As illustrated in FIG. 5, the preferred embodiment of the fire suppression/protection system 100 can draw water from multiple sources. Water may be drawn from the main public water supply 200 to the structure 102 which is already under pressure, or water may be pumped from a "raw" water supply 108, such as a pool, spa, lake, pond, river, underground or above ground storage tank, etc.

Water is supplied to the invention from the main public water supply 200 under the existing pressure head of the supply through a solenoid valve 202 to a chemical mixing and balance tank 204. A gate valve 206 is provided in the event that manual operation is desired or becomes necessary. A surfactant wetting compound and a fire retardant are introduced into the chemical mixing and balance tank 204 from one of a plurality of chemical supply containers 208. The wetting compound and the fire retardant are drawn from the supply containers 208 by a pump 210 and blended with source water in the chemical mixing and balancing tank 204 by a mixer 212. A liquid level controller 214 provides feedback to prevent overflow, i.e., high water level, of the mixing and balancing tank 204. The liquid level controller 214 also senses low water levels, i.e., a deficiency of utility water volume or line pressure, within the chemical mixing and balancing tank 204 and provides appropriate signals to the system control unit 114. The system control unit 114 can then initiate corrective action by energizing either or both a first suction pump 216 or/and second suction pump 218 which pumps water (by increasing the water line pressure) from the raw water supply 108 to the chemical mixing and balancing tank 204. In the preferred embodiment, the chemical mixing and balancing tank 204 has a one hundred gallon capacity and the chemical supply containers 208 have a twenty-five gallon capacity. The chemical mixing and balancing tank 204, chemical supply containers 208, the liquid level controller 214, and the mixer 212 are available as a prior art system from J. L. Wingert Company of Santa Ana, Calif.

The chemical mixing and balance tank 204 is the heart of the flow control over where water is pumped to or from in the duplex pumping station 112. The system control unit 114, once activated by the sensors 185, initiates the pumping of water from the main water supply 200 or the raw water supply 108 to the chemical mixing and balance tank 204 in both Phase1 and Phase2 of system operation. This ensures that the chemical mixing and balance tank 204 is always filled with water. It is the liquid level controller 214 that controls the operation of the first and second suction pumps 216 and 218, respectively, during a low water level condition in the chemical mixing and balancing tank 204. Likewise, the liquid level controller 214 via the system control unit 114 controls the operation of a first high pressure pump 220 and a second high pressure pump 222. Since both first and second high pressure pumps 220 and 222 are preset to pump the same volume of water continuously, the liquid level controller 214 maintains proper water flow regulation in the pumps 220 and 222 to avoid overheating and damage thereto. This control feature is achieved since the liquid level controller 214 is constantly monitored by the system control unit 114.

The wetting compound is preferably a biodegradable, polymer surfactant that can treat natural unsealed fiber, wood, stucco, and masonry material. It preferably has a viscosity of about 10 cP, a specific gravity of greater than 1.1 at 20 degrees Centigrade, a vapor density of greater than 10, an evaporation rate of less than 0.01, is 100% soluble in water, is nontoxic and nonvolatile, and is mutually compatible with a protein fire retardant described below. Such a surfactant is available from Union Carbide Chemicals and Plastics Company of Danbury, Conn. The use of the surfactant in the system water slows the evaporative process of water molecules thereby reducing the amount of water consumed. Further, the surfactant increases the surface tension so that the water molecules more readily adhere to the surface of, for example, the structure 102.

The fire retardant is preferably protein-based and is also designed to treat natural unsealed fiber, wood, stucco, and masonry materials. It preferably has a viscosity of about 10 cP, a specific gravity of about 1.2 at 70 degrees Fahrenheit, a specific weight of about 8 lbs/gallon, a pH of between 7.0 and 7.7, a vapor pressure of about 760 mm of Hg at 100 degrees Centigrade, a vapor density of greater than 1.15, has an evaporation rate of less than 0.01 and a volatility of less than 90% by volume, is 100% soluble in water, and is nontoxic. Finally, it is mutually compatible with the polymer surfactant described above. Such a fire retardant is available from NoChar of Indianapolis, Ind.

The chemically treated water is drawn from the chemical mixing and balance tank 204 through a gate valve 224 by either or both the first high pressure pump 220 or the second high pressure pump 222. Downstream of the gate valve 224 is a junction point 226 which splits the water line to form the first and second high pressure pumping sections 148 and 150, respectively, as shown in FIG. 5. The first high pressure pumping section 148 includes a computer controlled solenoid operated valve 228 and a gate valve 230 that in combination enables the independent flow of treated water to the first high pressure pump 220. Downstream of the first high pressure pump 220 is a pressure sensor/indicator 232 for sensing the discharge pressure of pump 220, a gate valve 234, and a check valve 236. In the preferred embodiment, the first high pressure pumping section 148 provides pressurized treated water to the Phase1 header 152 shown in FIG. 5. The Phase1 header 152 under normal conditions delivers treated water to the fog jet nozzles 130 via the fog jet water line 126 and to the parabolic volumetric distribution units 140 via the underground water line 142. Between check valve 236 and Phase1 header 152 is a junction point 238 and downstream of junction point 238 is a solenoid valve 240, a bypass gate valve 242, a pressure sensor 244 to sense the discharge header pressure, and a valve 246.

Likewise, the second high pressure pumping section 150 includes a computer controlled solenoid operated valve 248 and a gate valve 250 that in combination enables the independent flow of treated water to the second high pressure pump 222. Downstream of the second high pressure pump 222 is a pressure sensor/indicator 252 for sensing the discharge pressure of pump 222, a gate valve 254, and a check valve 256. In the preferred embodiment, the second high pressure pumping section 150 provides pressurized treated water to the Phase2 header 154 shown in FIG. 5. The Phase2 header 154 under normal conditions delivers treated water to the spiral jet water line 128 and the plurality of spiral jet nozzles 136. Between check valve 256 and Phase2 header 154 is a junction point 258 and downstream of junction point 258 is a solenoid valve 260, a bypass gate valve 262, a pressure sensor 264 to sense the discharge header pressure, and a valve 266.

In the preferred embodiment, the first high pressure pumping section 148 including the first high pressure pump 220 normally feeds the Phase1 header 152. However, if solenoid valve 240 and bypass gate valve 242 are closed and if solenoid valve 260 or bypass gate valve 262 is open, the first high pressure pump 220 is enabled to feed the Phase2 header 154. Likewise, the second high pressure pumping section 150 including the second high pressure pump 222 normally feeds the Phase2 header 154. However, if solenoid valve 260 and bypass gate valve 262 are closed and if either solenoid valve 240 or bypass gate valve 242 is open, the second high pressure pump 222 is enabled to feed the Phase1 header 152. Therefore, the use of solenoid operated valves 228 and 248, immediately downstream of the chemical mixing and balancing tank 204, enables independent and simultaneous flow of treated water to either or both of the first and second high pressure pumps 220 and 222.

Further, the use of the crossover valving scheme including the solenoid valves 240 and 260 and the bypass gate valves 242 and 262, respectively, enable either or both high pressure pumps 220 and 222 to deliver pressurized treated water to either the Phase1 header 152 or the Phase2 header 154 or to both the Phase1 header 152 and the Phase2 header 154, simultaneously. Either of the high pressure pumps 220 and 222 is capable of providing a discharge pressure, flow rate, and hydraulic head to the Phase1 header 152 or the Phase2 header 154 as is required by the number and type of fog jet nozzles 130 and parabolic volumetric distribution units 140 or the number and type of spiral jet nozzles 136, respectively. Pumps capable of satisfying the requisite specifications are available from F. H. Pumps, Inc. of Mission Viejo, Calif. Those of skill in the art will recognize that the choice of pump size for the high pressure pumps 220 and 222 depend upon the number and type of nozzles used for Phase1 and Phase2, which is directly dependent upon the surface area of the structure 102 and surrounding grounds 104 to be protected.

Through the use of the duplex pumping system 112, either or both of the high pressure pumps 220 and 222 can be used to provide pressurized treated water for both Phase1 and Phase2 in the event that one of the high pressure pumps 220 or 222 becomes inoperative. Pressure sensor/indicator 232 can sense a drop-off in discharge pressure from the first high pressure pump 220 and provides a corresponding signal to the system control unit 114. The system control unit 114 responds by deactivating the failing high pressure pump 220 and activating high pressure pump 222. Likewise, pressure sensor/indicator 252 can sense a drop-off in discharge pressure from the second high pressure pump 222 and similarly provides a signal to the system control unit 114. The system control unit 114 thereafter reconfigures the arrangement of the pumps 220 and 222 to provide pressure for the appropriate phase header. The solenoid operated valves 228 and 248 are remotely opened or closed by the system control unit 114 to cause one or the other (but not both) of the high pressure pumps 220 or 222 to operate or, in the alternative, to cause both of the pumps 220 and 222 to operate simultaneously.

The preferred embodiment of the invention also provides for an alternative source of raw water 108, supplied to the chemical mixing and balance tank 204 through a conveyance line 268, in the event that the main water supply 200 to the structure 102 becomes unavailable. A pair of screened suction inlets 270 and 272 are disposed in the raw water supply 108 which can be a pool, spa, underground or above ground storage tank, or a naturally occurring body of water such as a pond, stream, lake, etc. The screened suction inlets 270 and 272 each have a corresponding galvanized steel end-cap 274 and 276 and are each surrounded by a corresponding debris screen 278 and 280, respectively. The debris screens 278 and 280 are known in the art and typically are designed so that the entry point of the fluid through the screens 278, 280 can be either vertical or horizontal. The entry point for the water located on the debris screens 278, 280 is cut at an angle so that the water enters a narrow inlet and expands to a wider diameter. This design promotes water flow and minimizes the chance of debris clogging the suction inlets 270, 272 so that the first and second suction pumps 216 and 218 do not overheat.

The screened suction inlets 270 and 272 are each coupled to the duplex pumping station 112 through the pair of flexible lines 122 and 124, respectively, as shown in FIG. 5. Raw water is drawn through suction inlet 270 by the first suction pump 216 or, alternately, raw water is drawn through suction inlet 272 by the second suction pump 218. A pressure sensor/indicator 286 senses a drop in the pressure created by the first suction pump 216 when the suction inlet 270 becomes clogged. A signal is sent to the system control unit 114 indicating the pressure drop in suction pump 216. The system control unit 114 will shut down the first suction pump 216 in response to the signal and will activate the second suction pump 218. A small sidestream from the discharge of the active suction pump via a backflush line 288 is used to backflush the screened suction inlet not currently in use.

The water from the raw water source 108 is drawn into the duplex pumping station 112 via either or both a first suction pump section 290 or/and a second suction pump section 292. Notwithstanding which suction pump section 290 or 292 is connected to the raw water supply 108, the raw water passes through a three-way solenoid valve 294 as shown in FIG. 5. Located downstream of solenoid valve 294 is a junction point 296. The first suction pump section 290 includes a computer controlled solenoid operated valve 298 employed to direct the flow of water, a gate valve 300, the first suction pump 216, a gate valve 302, the pressure sensor/indicator 286, and a control valve 304. Likewise, the second pump section 292 includes a computer controlled solenoid operated valve 306 also employed to direct the flow of water, a gate valve 308, the second suction pump 218, a gate valve 310, a pressure sensor/indicator 312, and a control valve 314.

Thus, if the system initially activates the first suction pump section 290, the first suction pump 216 draws raw water from the raw water source 108 through the screened suction inlet 270 and the flexible line 122, three-way solenoid valve 294, solenoid operated valve 298, and gate valve 300. A small sidestream from the discharge of the first suction pump 216 is used to backflush the parallel screened suction inlet 272 through a gate valve 316 and a three-way valve 318 in backflush line 288 as shown in FIG. 5. If the pressure sensor/indicator 286 senses a significant drop-off in discharge pressure from the first suction pump 216, the system control unit 114 is notified via a monitoring signal as is known in the art. In response to the monitoring signal, the system control unit 114 deactivates the first suction pump 216 and activates the second suction pump 218. In order to accomplish this substitution, the three-way solenoid valve 294 is switched, solenoid operated valve 298 is remotely closed and solenoid operated valve 306 is remotely opened to enable water to be drawn by the second suction pump 218 through gate valve 308. Most of the raw water is discharged from the second suction pump 218 through gate valve 310 and control valve 314. A small sidestream of the discharge water of the second suction pump 218 is used to backflush the parallel screened suction inlet 270 through gate valve 316 and three-way valve 318 in backflush line 288 as shown in FIG. 5.

In the present invention, either the first suction pump 216 or the second suction pump 218 can be selected exclusively (i.e., to the exclusion of the parallel suction pump) to draw raw water from the raw water source 108. This is accomplished by remotely opening computer controlled solenoid operated valve 298 in the first suction pump section 290 and remotely closing computer controlled solenoid operated valve 306 in the second suction pump section 292 or visa versa. Thus, either suction pump 216 or suction pump 218 is operating, but not both. In the alternative, both solenoid operated valves 298 and 306 can be opened to enable simultaneous operation of both suction pumps 216 and 218. Likewise, both solenoid operated valves can be remotely closed to disable operation of both suction pumps 216 or 218.

In the preferred embodiment, either the first suction pump 216 or the second suction pump 218 is capable of creating the suction pressure, discharge pressure, flow rate, and hydraulic head that is necessary to satisfy the required flow rates of the Phase1 header 152 and the Phase2 header 154. Pumps capable of meeting the requisite specifications are available from F. H. Pumps, Inc. of Mission Viejo, Calif. Those of skill in the art will recognize that the choice of suction pumps 216 and 218 depend upon the flow rate required for the Phase1 header 152 and the Phase2 header 154 as well as the suction pressure at the individual pump given consideration of conveyance from the raw water source 108 to the individual pump 216 or 218.

The discharged raw water from the raw water source 108 via either or both of the suction pumps 216 or 218 must be filtered prior to being delivered to the chemical mixing and discharge tank 204. This is accomplished by providing a first filter station 320 and a second filter station 322 as shown in FIG. 5. The first filter station 320 includes a computer controlled solenoid operated valve 324 for controlling the flow of water, a ball valve 326, a pressure sensor/indicator 328, a first in-line filter 330, a ball valve 332, and a check valve 334. The second filter station 322 includes a computer controlled solenoid operated valve 336 for controlling the flow of water, a ball valve 338, a pressure sensor/indicator 340, a second in-line filter 342, a ball valve 344, and a check valve 346.

The ball valve 326 located between solenoid operated valve 324 and the pressure sensor/indicator 328 in the first filter station 320 and the ball valve 338 located between the solenoid operated valve 336 and the pressure sensor/indicator 340 in the second filter station 322 are utilized to isolate the first in-line filter 330 and the second in-line filter 342 for maintenance, respectively. The solenoid operated valve 324 which is circuited with the first in-line filter 330 and the solenoid operated valve 336 which is circuited with the second in-line filter 342 are controlled by the system control unit 114. Consequently, the two filter stations 320 and 322 provide independent and simultaneous flow paths to the chemical mixing and balance tank 204.

In the preferred, the raw water that is discharged from the first suction pump 216 is normally directed to the first in-line filter 330 via solenoid operated valve 324. Likewise, the raw water that is discharge from the second suction pump 218 is normally directed to the second in-line filter 342 via solenoid operated valve 336. However, either or both in-line filters 330, 342 can be matched with the output of either or both of the first or second suction pumps 216, 218 to provide chemically treated water to either or both of the first or second high pressure pumps 220, 222 via the chemical mixing and balance tank 204. This is accomplished by controlling the position of the solenoid operated valves 324 and 336 where one is open while the other is closed. Under the conditions in which neither of the suction pumps 216 or 218 is at full capacity, both solenoid operated valves 324 and 336 can be open placing both in-line filters 330 and 342 in service simultaneously.

In-line filters 330 and 342 are selected to have the capability to filter smaller matter from the water that are large enough to clog the fog jet nozzles 130 but that are not large enough to be retained by the debris screens 278 and 280 of the corresponding suction inlets 270 and 272, respectively. In the event that the first in-line filter 330 fouls and creates a pressure build-up, the pressure sensor/indicator 328 transmits a signal to the system control unit 114. The system control unit 114 then reconfigures the filter arrangement by redirecting the flow of water from in-line filter 330 to in-line filter 342. This is accomplished by closing solenoid operated valve 324 and opening solenoid operated valve 336. In the preferred embodiment, Ronningen-Petter bag filters are used which can be purchased from Filter Supply Company of Anaheim, Calif.

If the raw water source 108 is fairly free of particulate matter, the first and second filter stations 320 and 322 should have the capacity to operate properly given the expected volume of water which would be filtered during operation. The bag of each filter station 320 and 322 should be cleaned or replaced after each use. If the raw water supply is laden with particulate matter, a backwashing scheme similar to the one utilized for the screened suction inlets 270 and 272 can be employed. Under those conditions, the pressure sensor/indicators 328 and 340 are then used to determine when the maximum inlet pressure of the first and second in-line filters 330 and 342 is exceeded, respectively. If the maximum inlet pressure to the in-line filters 330, 342 is exceeded, this is an indication that the filters are clogged.

Raw water drawn from the raw water source 108 through the screened suction inlet 270 by the first suction pump 216 and filtered by in-line filter 330 flows into the chemical mixing and balance tank 204 through ball valve 332 and check valve 334. In the alternative, raw water drawn from the raw water source 108 through the screened suction inlet 272 by the second suction pump 218 and filtered by in-line filter 342 flows into the chemical mixing and balancing tank 204 through ball valve 344 and check valve 346. The path by which raw water is drawn from the raw water source 108 as is shown in FIG. 5. is through the screened suction inlet 272 since the pathway from the screened suction inlet 270 is blocked at three-way solenoid valve 294 as indicated by the shaded arrowhead.

It is emphasized that each bank of suction pumps 216 and 218, in-line filters 330 and 342, and high pressure pumps 220 and 222 are all independent systems controlled by their respective pressure sensor/indicators 286, 312, and 328, 340, and 232, 252. This design enables either of the suction pumps 216, 218 to be paired with either of the in-line filters 330, 342 and either of the high pressure pumps 220, 222. The design flexibility is further expanded because the fire suppression/protection system 100 is capable of operating both suction pumps 216, 218, and both in-line filters 328, 340 and both high pressure pumps 220, 222 simultaneously. In the startup mode of operation, only a single suction pump 216 or 218, a single in-line filter 330 or 342, and a single high pressure pump 220 or 222 will be in operation.

In the event that either of the suction pumps 216 or 218, in-line filters 330 or 342, or high pressure pumps 220 or 222 fail to perform properly as monitored by their individual pressure sensor/indicators, the system control unit 114 will close the appropriate solenoid operated valves, deactivate the failing pump or filter, and initiate operation of the parallel pump or filter in the appropriate bank. During this period, the system control unit 114 will automatically back-flush the non-operating screened suction inlet 270 or 272 and fouled in-line filter 330 or 342. This type of switching of pumping and filtering hardware occurs routinely during system operation. In the event that the period of cycling of the pumps and in-line filters increases, the system control unit 114 will initiate the operation of both sets of pumps and in-line filters together. This action ensures that the duplex pumping station 112 can operate at full capacity.

The various electrical signals transmitted from the liquid level controller 214, pressure sensor/indicators 232, 252, 286, 312, 328, and 340, temperature/heat sensors 188, flame/infrared detectors 192, smoke detectors 190, and sound/parabolic microphone sensors 186 are received by the process logic controller within the system control unit 114. The various electrical signals are processed and translated into electronic output signals to three-way solenoid valves 294 and 318, on-off solenoid valves 158, 228, 240, 248, 298, 260, 306, 324, 336, pump motors 216, 218, 220, 222, in-line filtration stations 320, 322, the chemical mixing and balance tank pump 210, and mixer motor 212. Each of these electronically controlled valves, filtration stations, motors, and pumps are utilized to direct the flow of water from the raw water source 108 through the water treatment and pumping stages and the Phase1 header 152 and Phase2 header 154 to the plurality of fog jet nozzles 130 and spiral jet nozzles 136.

The system control unit 114 can be, for example, a microprocessor-based programmable sequence controller, Model Number H-02182-10, manufactured by Cole-Parmer of Niles, Ill. This controller is capable of controlling forty devices, integrating up to twenty input signals to control the output signals. Controller functions include automatic and manual program operations, time intervals, and looping. The system control unit 114 can control up to forty-nine loops with ten-thousand loop cycles within each one-hundred step program. Loops can be nested. The program time intervals have a resolution within 0.01 seconds from input to output. The system control unit 114 includes a lithium battery that protects against program memory loss due to power failures or interruptions for at least five years.

The sizing of component pieces of the subsystems of the fire suppression/protection system 100 including the fog jet nozzles 130, the spiral jet nozzles 136, the capacity of the chemical mixing and balance tank 204, the pumping capacity of the suction pumps 216 and 218, the high pressure pumps 220 and 222, and the chemical mixing and balance tank pump 210, etc., is determined by known variables specific to the structures 102 and surrounding grounds 104 to be protected. These specific variables include the surface area coverage (in square feet), of the structural surface to be protected, length (in feet) of the treated water conveyance lines along the covered surfaces, and the inside and outside diameter of the conveyance lines (in inches), differential elevations (in feet) between the water source(s), the pump/treatment station and the structure(s) being protected, and application angles (in degrees of angle) at eaves, gables, corners, etc.

Once these site specific variables are defined, the following can be calculated using standard engineering practices: the overlapping fog jet nozzle 130 and spiral jet nozzle 136 coverage patterns of the treated water onto the structural surfaces, the quantity, spacing, and model type of fog jet nozzles 130 and spiral jet nozzles 136, water flow rates/throughput from the water source(s) to and from the pump/treatment station through the conveyance lines to each nozzle, total hydrostatic head, conveyance line pressures and friction losses, pump discharge pressures, and the size of each pump and motor driver, size of the filtration unit, size of the chemical mixing and balancing tank 204, the total electric load/duty of the system from startup through peak operation, and the size of the backup electrical power generator unit 116.

The backup electrical power generator unit 116 is included in the design of the fire suppression/protection system 100 to ensure a continuous, uninterrupted supply of electrical power to operate the entire system during the approach and pass through of a wildfire 106. The standard electrical power generation unit 116 consists of an automatic electrical transfer switch that senses a decline in power from the public utility grid and responds instantly (i.e., within a few electrical cycles) to start the driver and electrical generator via a battery bank, a diesel fueled 75 HP prime mover driver authorized by the local air quality control authorities, a 60 KW Model 60DGCB electrical power generation unit capable of providing 230/460 volts at 60 Hertz at full startup load amperage, and a control panel that electronically integrates the electrical power generator unit 116 with the remainder of the fire suppression/protection system 100. The backup power generator unit 116 is known in the prior art and is readily available from Cummins Cal Pacific, Inc. located in Irvine, Calif.

The fire suppression/protection method of operation will now be described. The deployment of the above described process is accomplished in phases of detection and operation. The detection of an approaching wildfire event is most critical in being able to allow sufficient time for deployment of the system and creation of the dome of high pressure cool air 146. Phase1 of operation occurs initially followed by the activation of Phase2. The invention utilizes sound (via the plurality of parabolic microphone sensors 186) to detect the approaching fire. The air molecules involved in a wildfire produce a distinctive sound signature which is detected by the plurality of parabolic microphone sensors 186. The microphone sensors 186 are located about the perimeter of the surrounding grounds 104 as shown in FIG. 1. The use of the sound detection method allows for a greater reaction time needed to adequately develop the dome of high pressure cool air 146 and to wet the surrounding grounds.

The distinctive sound signature of the wildfire 106 is read and understood by the system control unit 114 which, in turn, activates Phase1 of operation. Phase1 includes the activation of the hardware of the duplex pumping station 112 shown in FIG. 5 such as pumps, filters, the chemical mixer 212, and the like. Next, the parabolic volumetric distribution units 140 are activated to deploy the chemically treated water over large areas to create the dome of high pressure cool air 146 and to wet the surface of the structure 102 and surrounding grounds 104. Next, the duplex pumping station 112 charges the fog jet water line 126 to activate the plurality fog jet nozzles 130 to further wet the structure 102. In addition, the system control unit 114 transmits an emergency signal typically via telephone line to a warning system which activates a local alarm about the structure 102 and surrounding grounds 104. Furthermore, the warning system is circuited to also transmit an emergency warning signal to announce the wildfire to the local fire department.

Phase2 of operation is controlled by the second set of sensors 185 also located about the perimeter of the surrounding grounds 104 and on the structure 102 and pump house 110. These sensors 185 include the heat detectors 188, smoke detectors 190, and infrared detectors 192 which detect high temperature, smoke, fire, and embers. The fire suppression/protection system 100 will then, in turn, activate Phase2 of protection by deluging the structure 102 through a distribution system comprising the plurality of spiral jet nozzles 136. The spiral jet water line 128 is charged by the duplex pumping station 112 which activates the spiral jet nozzles 136 located primarily on the structure 102 and the pump house 110 and in areas that a fire could normally start. The spiral jet nozzles 136 which are known in the art eject water which exits through a broad mouth opening to strike a spiral diffuser. This ensures a distribution of the treated water over a broad area of the structure 102. During Phase2 operation, both Phase1 fog jet nozzles 130, Phase2 spiral jet nozzles 136, and the parabolic volumetric distribution units 140 are operating simultaneously. Phase1 and Phase2 of the invention are designed to operate on normally available utility water and power supplies but also include the raw water source 108 and the backup electrical power generator unit 116.

Figure 6:
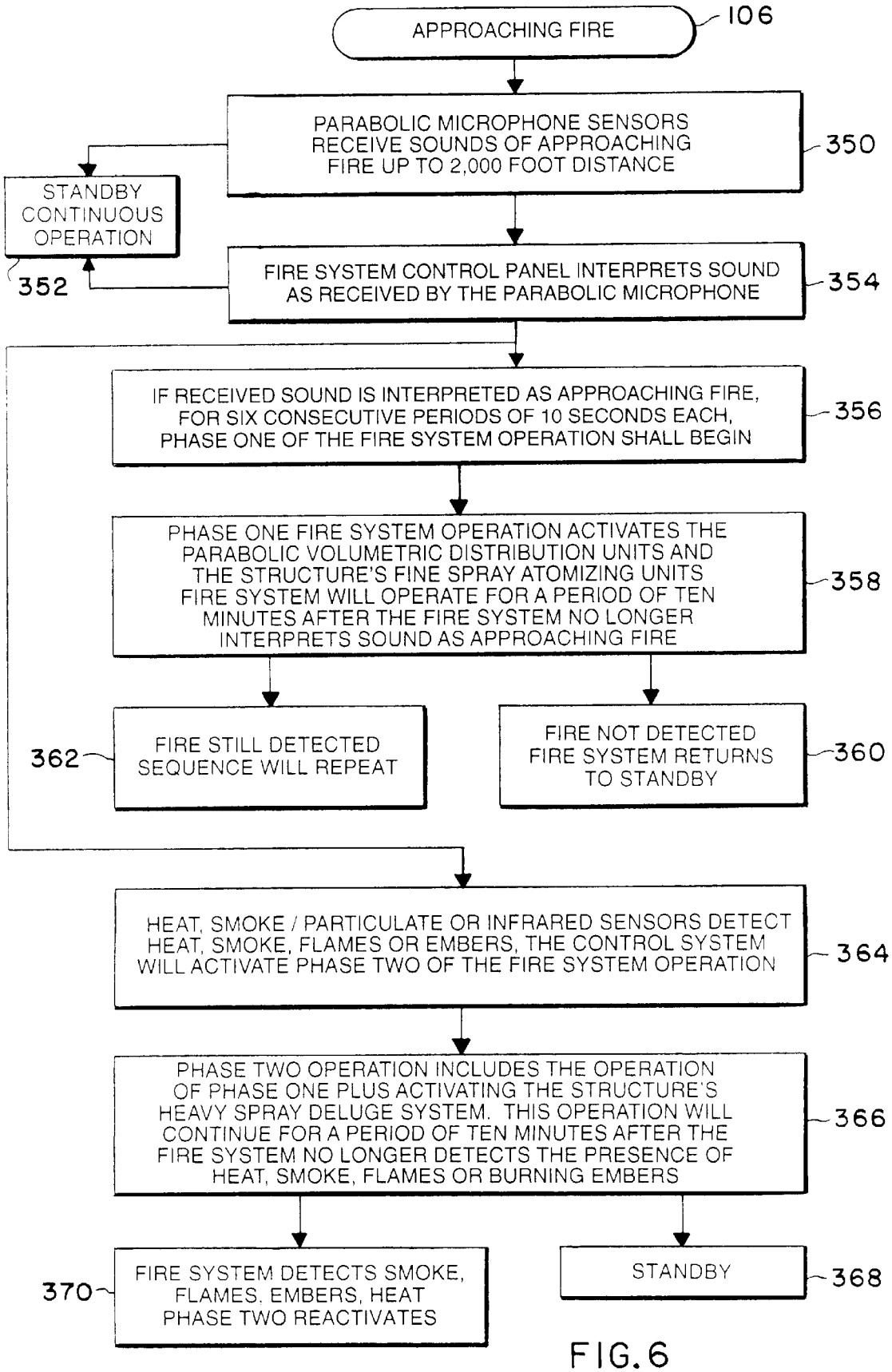
FIG. 6 is a flow diagram of the system control unit of the fire suppression/protection system of FIG. 1 showing the steps for activating Phase1 and Phase2 of the system.

Reference will now be made to FIG. 6 which illustrates a flow diagram of the system control unit 114 showing the steps for activating Phase1 and Phase2 of the fire suppression/protection system 100. The approaching wildfire 106 is illustrated in a box at the top of the diagram. The parabolic microphone sensors 186 receive the sounds of the approaching wildfire 106 from up to a distance of two thousand feet as is indicated in box 350. The receipt of the sound signals by the parabolic microphone sensors 186 places the fire suppression/protection system 100 on standby continuous operation as indicated in box 352. The system control unit 114 then receives and interprets the sound as received by the parabolic microphone sensors 186 to determine if the sound is indicative of an approaching wildfire 106 as indicated by box 354. If the received sound is interpreted by the system control unit 114 as an approaching wildfire 106 for six consecutive periods of time of ten seconds each, Phase1 of the operation of the fire suppression/protection system 100 will begin as indicated by box 356 on FIG. 6. The system 100 will also maintain the standby continuous operation status as is shown in box 352.

The initiation of Phase1 of operation of the fire suppression/protection system 100 activates the parabolic volumetric distribution units 140 and the fine spray fog jet nozzles 130 which operate continuously for the period of time plus ten minutes beyond which the system control unit 114 no longer interprets the received sound as an approaching fire 106. This step in the method is illustrated in box 358 of FIG. 6. At this point, either the system control unit 114 no longer interprets the received sound as an approaching wildfire 106 or subsequently received sound is interpreted as an approaching wildfire 106. If a wildfire 106 is no longer detected, the fire suppression/protection system 100 returns to standby continuous operation as is indicated in box 360. However, if the received sound or subsequently received sound is interpreted as an approaching wildfire 106, the sequence of Phase1 appearing in FIG. 6 will repeat as is indicated in box 362. The sequence of system operation then returns to the Phase1 functions as set forth in box 358.

The output signal from box 354 in which the system control unit 114 interprets the sound as received by the parabolic microphone sensors 186 (for initiating Phase1) is also utilized to determine if heat, smoke, flames, or embers are present. If the heat sensors 188, smoke/particulate detectors 190, or infrared detectors 192 sense heat, smoke, flames, or embers, the system control unit 114 will activate Phase2 of the fire suppression/protection system 100 as shown in box 364. The activation of Phase2 of the operation includes the continuation of Phase1 (i.e., the creation of the dome of high pressure cool air 146 and the operation of the fog jet nozzles 130) plus the activation of Phase2 (i.e., the spiral jet nozzles 136 deluge the surface of the structure 102 and pump house 110).

The initiation of Phase2 will operate continuously for the period of time plus ten minutes beyond which the system control unit 114 no longer detects the presence of heat, smoke, flames, or burning embers of an approaching wildfire 106. This step in the method is illustrated in box 366 of FIG. 6. At this point, either the system control unit 114 no longer detects heat, smoke, flames, or burning embers of an approaching wildfire 106 via sensors 185 or the system control unit 114 continues to detect heat, smoke, flames, or burning embers of an approaching wildfire 106. If the heat, smoke, flames, or burning embers of a wildfire 106 are no longer detected, the fire suppression/protection system 100 returns to standby continuous operation as is indicated in box 368. However, if heat, smoke, flames, or burning embers of an approaching wildfire 106 continue to be detected, the sequence of Phase2 appearing in FIG. 6 is reactivated as is indicated in box 370. The sequence of system operation then returns to the Phase2 functions as set forth in box 366.

The present invention provides novel advantages over other methods and systems for fire suppression and prevention known in the art. The main advantages include the use of sound to identify an approaching wildfire 106 which provides more lead time to activate the system. The sound is then utilized to initiate Phase1 of operation which includes the development of the dome of high pressure cool air 146 and the wetting of surfaces which serve to impede and follow the approaching wildfire 106 prior to the fire entering the grounds 104 surrounding the structure 102. If the fire does enter the surrounding grounds, Phase2 of the operation is activated to deluge the structure 102 and pump house 110 with water to protect the property.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

It is therefore intended by the appended claims to cover any and all such modifications, applications, and embodiments within the scope of the present invention. Accordingly,

What is claimed is:

1. A two-phase fire suppression/protection system for structures and surrounding grounds comprising:

first means for sensing sounds produced by an approaching wildfire and for providing a first signal in response thereto;

second means for interpreting said first signal for identifying said approaching wildfire;

a plurality of parabolic volumetric distribution units for generating a dome of high pressure cool air for encapsulating a plurality of the structures and the surrounding grounds for impeding said approaching wildfire;

fourth means for providing an environment of cool air surrounding each of said structures; and fifth means for deluging said structures with water when a plurality of parameters indicate said wildfire has entered said surrounding grounds.

2. The two-phase fire suppression/protection system of claim 1 wherein said first means for sensing the sounds produced by the approaching wildfire comprises a plurality of parabolic microphone sensors.

3. The two-phase fire suppression/protection system of claim 1 wherein said second means for interpreting said first signal comprises a system control unit.

4. The two-phase fire suppression/protection system of claim 1 further comprising a parallel set of pumps, filters, and valves for said distribution units.

5. The two-phase fire suppression/protection system of claim 4 wherein said parallel set of pumps, filters, and valves can be operated simultaneously.

6. The two-phase fire suppression/protection system of claim 1 wherein said fourth means for providing the environment of cool air for surrounding each of said structures comprises a plurality of water atomizing heads mounted on said structures.

7. The two-phase fire suppression/protection system of claim 1 wherein said fifth means for deluging said structures with the water comprises a plurality of high volume discharge heads mounted on said structures.

8. The two-phase fire suppression/protection system of claim 1 further including a plurality of thermal sensors for sensing said plurality of parameters indicative of said wildfire.

9. The two-phase fire suppression/protection system of claim 1 further including a plurality of smoke detectors for sensing said plurality of parameters indicative of said wildfire.

10. The two-phase fire suppression/protection system of claim 1 further including a plurality of infrared sensors for sensing said plurality of parameters indicative of said wildfire.

11. The two-phase fire suppression/protection system of claim 1 wherein said dome of high pressure cool air is self-aligning with a moving front of said approaching wildfire.

12. The two-phase fire suppression/protection system of claim 1 further including a chemical mixing tank for mixing a surfactant with said water for reducing evaporation thereof.

13. The two-phase fire suppression/protection system of claim 1 further including a backup electrical power generator.

14. A two-phase fire suppression/protection system for structures and surrounding grounds comprising;

first means for sensing sounds produced by an approaching wildfire and for providing a first signal in response thereto;

second means for interpreting said first signal for identifying said approaching wildfire;

a plurality of parabolic volumetric distribution units for generating a dome of high pressure cool air for encapsulating a plurality of the structures and the surrounding grounds for impeding said approaching wildfire wherein each of said parabolic volumetric distribution units comprises a motor-driven fan blade for projecting atomized water into the air to form said dome of high pressure cool air;

fourth means for providing an environment of cool air surrounding each of said structures; and fifth means for deluding said structures with water when a plurality of parameters indicate said wildfire has entered said surrounding grounds.

15. A two-phase fire suppression/protection system for structures and surrounding grounds comprising:

a plurality of parabolic microphone sensors for sensing sounds produced by an approaching wildfire and for providing a first signal in response thereto;

a system control unit for interpreting said first signal for identifying said approaching wildfire;

a plurality of parabolic volumetric distribution units for generating a dome of high pressure cool air for encapsulating a plurality of the structures and the surrounding grounds for impeding said approaching wildfire;

a plurality of water atomizing heads for providing an environment of cool air surrounding each of said structures; and means for deluging said structures with water when a plurality of parameters indicate said wildfire has entered said surrounding grounds.

* * * * *